United States Patent [19]

Welker

[11] Patent Number: 4,470,773

[45] Date of Patent: Sep. 11, 1984

[54] RESILIENT CHAMBER FLUID SAMPLER HAVING VACUUM BREAKER APPARATUS

[75] Inventor: Robert H. Welker, Sugar Land, Tex.

[73] Assignee: Walker Engineering Company, Sugar Land, Tex.

[21] Appl. No.: 419,725

[22] Filed: Sep. 20, 1982

[51] Int. Cl.[3] ..... F04B 43/00; F04B 39/08

[52] U.S. Cl. ..... 417/479; 417/520

[58] Field of Search ..... 92/90; 417/479, 514

[56] References Cited

U.S. PATENT DOCUMENTS

| | | | |
|---|---|---|---|
| 2,745,349 | 5/1956 | Tavola | 417/514 |
| 2,929,332 | 3/1960 | Pierce | 417/479 |
| 3,945,770 | 3/1976 | Welker | 417/479 |
| 4,261,690 | 4/1981 | Doescher | 417/479 |
| 4,403,518 | 9/1983 | Welker | 417/479 |

FOREIGN PATENT DOCUMENTS

| | | | |
|---|---|---|---|
| 334922 | 9/1930 | United Kingdom | 417/479 |

*Primary Examiner*—William L. Freeh

*Attorney, Agent, or Firm*—Gunn, Lee & Jackson

[57] ABSTRACT

In a resilient chamber sampling apparatus incorporating a resilient body having a dished cavity area which is squeezed to pressure fluid trapped in the dished area, an improved form preferably incorporates an alternate anvil. It has a facing plate member at the end of the probe over a solid anvil. The cap or plate has a small hole in the center and telescopes with a small peripheral skirt aligning the cap with the resilient plug. On closure, high pressure is formed to force fluid from the cavity in the resilient body. When the probe is pulled away from the resilient body, the vacuum breaker slides in telescoping movement, and opens an external passage to fill the chamber where the fluid was pumped from, and the chamber is restored to its full size without pulling a vacuum, to avoid damage which might occur otherwise.

8 Claims, 3 Drawing Figures

RESILIENT CHAMBER FLUID SAMPLER HAVING VACUUM BREAKER APPARATUS

BACKGROUND OF THE DISCLOSURE

In the previously issued patent of the present inventor, a sample collection system was disclosed. Briefly, it utilizes a reciprocating plunger which moves a solid member against a resilient plug having a dished area. When immersed in fluid, the dished area captures fluid. As pressure is applied, the dished area is reduced in volume and thereby forces the captured fluid to flow through a check valve in the solid member. The check valve connects with a flow line, and the sample is removed by this procedure. Sampling rate is controlled rather easily, and the sample is delivered in a predictable fashion. The sample is captured in measured quantity and flows through the check valve.

A sample collection probe apparatus of this nature functions in a cyclical fashion, perhaps operating several times per minute. Typically, they are operated around the clock. This inevitably places substantial wear on the resilient plug. Because it is compressed and flexed repetitively, it runs the risk of fatigue and tearing. This particularly is aggravated because there is fatigue as it is pressured to closure, and there is also fatigue as the components are pulled apart, thereby breaking the vacuum formed in the dished area. Assume for descriptive purposes that the dished area is reduced in volume by 99%. The fluid captured in that area is forced out through a check valve. As the parts are pulled back from one another, the dished area expands and pulls a vacuum. This vacuum tends to distort the lip area encircling the dished plug, and damage may occur. The resilient plug has been held successfully in place by means of an overlayed peripheral lip locking against the body of the resilient plug and lapping over the exposed face. While this has met with some success, there is still a tendency for fractures to be formed in the resilient plug. Such fractures damage the plug, and initiate delamination, that is, the breaking away of substantial portions of the resilient plug.

The present apparatus is an improvement which extends the life of the resilient plug by breaking the vacuum which is formed at the time the parts are retracted from one another. The component parts are forced together and the resilient plug is deformed. Thereafter, they are pulled apart and vacuum is formed as described above. With this apparatus, the vacuum does not persist for very long, and the vacuum is relieved by moving a cannister type cap over the end of the solid member. This is typically on the end of the probe. This cannister or cap telescopes, and forms a seal when jammed against the resilient plug in the intended fashion. Telescoping movement permits it to separate slightly, thereby creating a leakage path which breaks the vacuum. This leakage path relieves vacuum in the area of the dished recess and enables the two parts to be separated.

BRIEF DESCRIPTION OF THE DRAWINGS

So that the manner in which the above recited features, advantages and objects of the invention, as well as others, which will become apparent, are attained and can be understood in detail, a more particular description of the invention, briefly summarized above, may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

DETAILED DESCRIPTION OF THE PREFERRED EMBODIMENT

Figure 1:
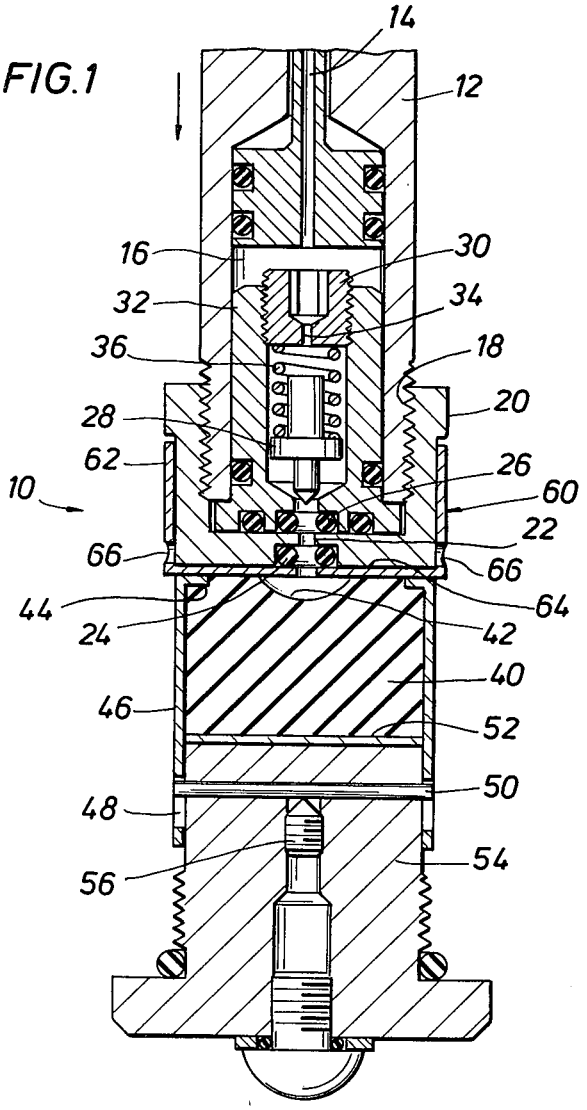
FIG. 1 is a sectional view through a sample collection apparatus incorporating a resilient dished plug and illustrating the vacuum breaker apparatus of the present disclosure installed therewith.

Attention is first directed to FIG. 1 of the drawings which identifies the apparatus of the present invention in its context. The numeral 10 refers to the entirety of the equipment. It is shown in greater detail in the previously issued patent of the present inventor, U.S. Pat. No. 3,945,770. That patent sets out a vanishing chamber hydrocarbon sampling apparatus. It utilizes an elongate probe 12, the numeral 10 identifying all of the apparatus shown in FIG. 1. The numeral 10 identifies what will be referred to hereinafter as the improved sampler apparatus, the improvement particularly focusing on the vacuum breaking construction including therein. The probe 12 reciprocates downwardly. It includes an elongate hollow body with a passage at 14 for evacuating sample. The passage 14 opens into a chamber 16. The chamber is an internal chamber within a thin wall tubular member terminating at a lower threaded portion 18. An anvil 20 is received over the lower end. The anvil has a flat faced threaded union which joins to the reciprocating probe at the thread 18. It is constructed with an internal recess at 22, this having a form of a centered axial passage, there being a counter sunk shoulder thereabout for receiving an O-ring 24. The sample flows through the passage 22. A resilient O-ring 26 comprises a valve seat for a check valve element 28. The check valve 28 terminates in a tapered valve element which rams against the O-ring 26. It will be observed that the O-ring 26 is located at the interior, axially aligned with the passage 22 and is located to serve as a check valve in connection with the valve element 28.

The check valve construction includes a plug 30 which is secured within a cylindrical body 32. There is small passage 34 which communicates the fluid pathway to the passage 14. The chamber 16 delivers fluid under pressure in a timed fashion, there being a surge of fluid on every reciprocation in the equipment.

The plug 30 secures a coil spring 36 in place. The coil spring 36 seats on a surrounding shoulder about the valve element 28. It is captured in a chamber having a tapered lower portion, and the valve element itself is tapered at its lower end to align with the lower portions of that chamber whereby the tip of the valve element seats against the resilient ring 26. Fluid can flow upwardly along the illustrated path. It does not flow back out of the chamber 16 because the check valve closes to prevent backflow.

This probe works against a resilient plug 40. The plug 40 has a peripheral surrounding lip adjacent to a dished recess 42. The lip is protected around its exterior lip by means of a overhang, the overhang being identified at 44 affixed to a telescoping sleeve 46. The sleeve 46 telescopes over a range. The sleeve encloses the resilient plug 40. It has the overhanging lip at 44 to lock the two members together. The resilient plug 40 is compressed when the anvil apparatus thereabove reciprocates toward it. The telescoping sleeve 46 slides downwardly. It has an external slot 48 which receives a fastening pin 50. The elongate slot is located at both pin ends so that the pin 50 holds the apparatus together and yet permits reciprocating movement. The pin 50 is incorporated for the purpose of joining the telescoping sleeve so that it is held and yet permits some sliding or axial movement. Moreover, the resilient plug is joined to a non extrusion disc 52, the disc 52 fits snugly within the telescoping member 46, and rests above a sized protruding cylindrical post 54 that fits just within the telescoping sleeve 46. The post 54 is axially drilled to receive a threaded member 56 which locks the pin 50 in position.

In the routine use of the equipment as described in the mentioned patent, a seal is perfected around the dished area 42. This seal is achieved through pressure on the plug which seals against the face of the anvil which reciprocates against it. When sealing is accomplished, fluid in the near area is captured in the cavity. The cavity has a specified volume. This volume is reduced as axial loading is applied, and eventually disappears. It disappears as axial loading is applied and the resilient material flows to reduce this chamber 42. This chamber volume is reduced, thereby forcing any fluid which is captured in it through the passage 22 through the check valve. This evacuation occurs as the cavity 42 is reduced in volume. Total reduction of the cavity is not required; substantial reduction does normally occur to set up stresses in the resilient plug. Moreover, substantial reduction of this volume to a minimum volume (that minimum is primarily in the passage 22 and hence is very small), and this reduction in volume creates a vacuum when the axial force is released. The resilient plug 40 characteristically restores itself to the original size and shape. Characteristically, such restoring occurs on every stroke. It tends to draw back any fluid which is captured in the passage 22 and which has not passed through the check valve. Once the fluid passes the check valve element and the seat cooperative therewith, the fluid cannot be recalled. As will be observed, this occurs repetitively on every stroke.

The present invention contemplates an improvement wherein a vacuum breaker plate 60 is positioned around the anvil. It has an upstanding skirt 62 that fits snugly around the exterior. It has a lower transverse facing plate 64. The facing plate captures the ring 24 and perfects sealing against it so that lateral flow does not occur. The seal ring 24 thus helps isolate the passage 22 and prevents leakage to the side. The vacuum breaker plate fits snugly, having the form of a cannister or cylindrical construction. It fits snugly adjacent to the passage 22 to prevent excessive enlarging the dead volume in that passage. Vacuum in the recessed area 42 pulls the vacuum breaker plate downwardly.

Figure 2:
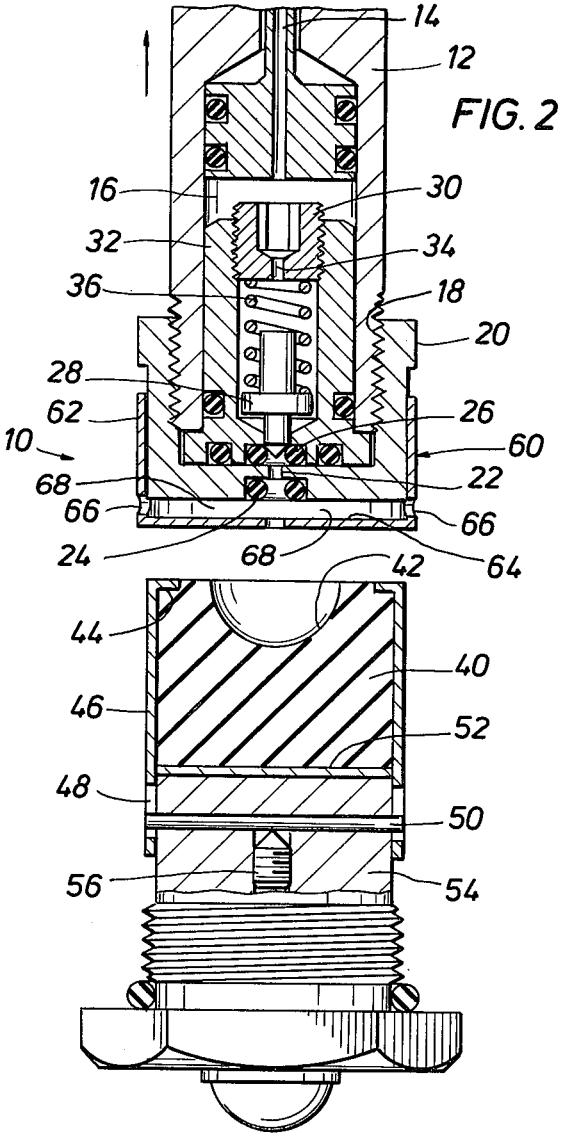
FIG. 2 is a view similar to FIG. 1 showing the apparatus after it separates wherein the vacuum formed in the dished area pulls the sample breaker apparatus and draws fluid produce in to break the vacuum.

Attention is directed now to FIG. 2 of the drawings. There, the vacuum breaker plate 60 has moved downwardly. Upward motion has occurred, and the resilient plug 40 has moved relatively away from the anvil and this motion draws the vacuum plate 60 toward it. The vacuum breaker plate is pulled downwardly as the recessed 42 redevelopes in the resilient body. As the axial load is decreased, a vacuum pull is observed whereby the telescoped vacuum breaker plate moves downwardly. It creates a flow path at 68. The flow path 68 exposes small ports 66 at two or three locations around the vacuum breaker plate. They are not located at the face 64. Rather, they are located just at the outside periphery. They are located at a point sufficiently below the anvil to have access to the flow path 68. This enables surrounding fluid to flow back into the area past the seal ring 24 which is incorporated to isolate this flow path 68. When sealing contact is broken with the O-ring 24, flow into this space continues into the cavity 42, thereby breaking the vacuum. This enables slight movement of the vacuum breaker plate 60 at which time the vacuum is interrupted, and the resilient plug is then free to break away and is restored to its original shape, not working against a vacuum and free of damage as a result of overcoming the vacuum.

Figure 3:
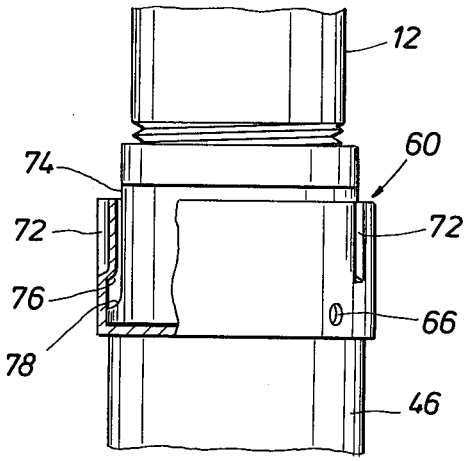
FIG. 3 is a detailed view showing means for aligning the sample breaker apparatus aligned for reciprocating movement.

It is possible for the vacuum breaker plate 60 to pull completely off. This is prevented by the arrangement shown in FIG. 3. There, an indention 72 is formed along the side of the vacuum breaker plate 60. The indention is a locking means cooperative with a flat or groove formed at 74. The flat or groove has a specified depth, there being a protrusion 76 which terminates the end of the indention 72 to forms a locking shoulder cooperative with a companion locking shoulder 78. The locking shoulder 78 is located on the exterior of the anvil, and blocks the indention 72. Two or three sets of indentions 72 are formed, having the preferred form of vertical dimples or creases better shown in FIG. 3. This limits the reciprocation of the vacuum breaker plate. It is sufficient that only slight movement be made whereby the opening 66 is exposed to deliver fluid from the exterior to break the vacuum.

The range of travel of the vacuum breaker plate is just a fraction of an inch, perhaps a millimeter or so. This is normally sufficient to break the seal at the O-ring 24. That is sufficient to interrupt the vacuum long after the check valve has closed without delivering fluid through the check valve. Moreover, he existence of a vacuum in the area assists in closing the check valve to prevent drawing fluid product into the sample collection apparatus.

The foregoing is directed to the preferred embodiment but the scope is determined by the claims which follow.

What is claimed is:

1. In a reciprocating sample collection apparatus which apparatus incorporates a motor means driving a reciprocating member relative to a fixed member of the sample collection apparatus, a sample collection apparatus comprises:

(a) a resilient plug;

(b) a solid anvil member cooperative with said resilient plug;

(c) opposing faces on said anvil and said resilient plug adapted to be moved toward contact;

(d) an indention having the form of a recess surrounded by a shoulder in one of the two faces to define a sample receiving chamber therein when a motor means reciprocates said two faces into sealing contact with one another wherein said recess is filled with a fluid to be pumped by the reciprocating sample collection apparatus, and filling occurs on submerging said recess in the fluid to be pumped;

(e) passage means communicating from said recess to deliver sample under pressure when pressure is formed as the recess is reduced in volume to force sample therefrom through said passage means;

(f) a transverse plate incorporating one of said faces, said plate having an opening therein to comprise a portion of said passage means;

(g) means for supporting said transverse plate for contact in sealing engagement to seal fluid in said recess;

(h) means mounting said plate for movement in response to vacuum pull occurring on separation of said faces; and (i) fluid introduction flow path means selectively operated by movement of said plate to deliver fluid from the exterior into said recess for breaking the vacuum pull thereof against said plate.

2. The apparatus of claim 1 including an upstanding circular skirt around said plate, said plate having the form of a circular disk with a central opening.

3. The apparatus of claim 1 wherein said anvil has a solid face with an opening therein comprising a portion of said passage means connects to a check valve means limiting flow to one direction.

4. The apparatus of claim 1 including an opening for said anvil, a countersunk area about said opening sized to receive a seal means contacting said plate and sealing between said plate and said anvil to define said passage means, said plate moving away from said seal means to enable behind said plate.

5. The apparatus of claim 4 wherein said plate is mounted by a skirt surrounding said plate aligning said plate for movement parallel to said anvil into and out of sealing engagement with said seal means.

6. The apparatus of claim 5 wherein said skirt has opening formed therein to leak behind said plate to comprise a portion of said flow path means.

7. The apparatus of claim 6 including skirt located aligned means positioning said plate and skirt for sliding movement as a unit around said anvil.

8. An accessory for a sample collection pump of the type having a resilient plug having a face opposed to and squeezed by a solid anvil having a face, therebeing a recess in one of the opposing faces of said plug and anvil, the accessory comprising an encircling edge located skirt around a central facing plate having an opening therein and further including means mounting said facing plate for contact with the face of said resilient plug, wherein said plug and anvil force fluid in the recess under pressure along a passage means on squeezing fluid from the recess, said plate slidably moving away from said resilient plug to break vacuum in said recess formed after squeezing the recess at which the recess enlarges to create vacuum.

* * * * *